US009767761B2

(12) United States Patent
Shiibayashi et al.

(10) Patent No.: US 9,767,761 B2
(45) Date of Patent: Sep. 19, 2017

(54) DRIVER CIRCUIT

(71) Applicant: LAPIS Semiconductor Co., Ltd., Yokohama (JP)

(72) Inventors: Kenichi Shiibayashi, Yokohama (JP); Koji Higuchi, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 146 days.

(21) Appl. No.: 14/845,266

(22) Filed: Sep. 3, 2015

(65) Prior Publication Data

US 2016/0071479 A1 Mar. 10, 2016

(30) Foreign Application Priority Data

Sep. 9, 2014 (JP) ..... 2014-183077

(51) Int. Cl.
*G09G 3/36* (2006.01)

(52) U.S. Cl.
CPC ..... *G09G 3/3696* (2013.01); *G09G 3/3688* (2013.01); *G09G 2310/0291* (2013.01); *G09G 2320/0223* (2013.01)

(58) Field of Classification Search
CPC ..... G09G 2310/027; G09G 3/3688; G09G 3/3696; G09G 2310/0291; G09G 2310/0289; G09G 3/3275; G09G 3/3685
See application file for complete search history.

(56) References Cited

U.S. PATENT DOCUMENTS 6,002,384 A * 12/1999 Tamai ..... G09G 3/3688 345/208
2007/0171163 A1* 7/2007 Miyata ..... G09G 3/3614 345/87
2013/0135272 A1* 5/2013 Park ..... G09G 3/3233 345/211

FOREIGN PATENT DOCUMENTS

JP 2007-037191 A 2/2007
JP 2008-292926 A 12/2008

* cited by examiner

*Primary Examiner* — Koosha Sharifi-Tafreshi
(74) *Attorney, Agent, or Firm* — Rabin & Berdo, P.C.

(57) ABSTRACT

A driver circuit driving a display device comprises: a gradation voltage generating circuit for generating m gradation voltages (m is an integer larger than or equal to 2) indicative of m stages of gradation levels; n decoder circuits each configured to select, out of the m gradation voltages, n drive voltages (n is an integer larger than or equal to 2) corresponding to n data pieces on the basis of n input gradation signals; m gradation voltage wirings each for transferring the m gradation voltages to the n decoder circuits, respectively; and a charge supplementing circuit for supplementing each of the m gradation voltage wirings with an amount of electric charge when a voltage drop occurs in the gradation voltage wirings.

11 Claims, 8 Drawing Sheets

DRIVER CIRCUIT

BACKGROUND OF THE INVENTION

1. Field of the Invention

The present invention relates to driver circuits for driving display devices, and more particularly relates to a driver circuit for supplying gradation voltages corresponding to an input video signal to each of a plurality of data lines formed on a display panel.

2. Background Art

For example, a two-dimensional display panel such as liquid crystal display panels includes a plurality of data lines (source lines) extending in a vertical direction within an in-plane direction of a screen, and a plurality of scan lines (gate lines) extending in a horizontal direction. For example, the display panel is placed on a glass substrate. The display panel on the substrate has, for example, an outer peripheral area, where a driver circuit that is a device for driving the display panel is provided.

The driver circuit generates, on the basis of a video signal input from the outside, gradation voltages corresponding to the luminance level of each pixel in the display panel, and applies the gradation voltages to each of the data lines of the display panel.

For example, Japanese Patent Application Laid-Open No. 2008-292926 discloses liquid crystal driving ICs (10*a*, 10*b*) which are connected in cascade and disposed in adjacent to each other. The liquid crystal driving ICs (10*a*, 10*b*) have gradation voltage generating circuits (110) each disposed at the center of the ICs. The gradation voltage generation circuits (110) are each provided with gradation voltage equalizing terminals (Qa, Qb, Qc, Qd) for equalizing gradation voltages. The terminals are each connected to their corresponding terminals through a gradation voltage equalization line (Sa) having a linear shape.

Japanese Patent Application Laid-Open No. 2007-37191 discloses a voltage generating circuit, including a first selector of a first conductivity-type, $2^a$ pieces of second selectors of the first conductivity-type, a first selector of a second conductivity-type, and $2^a$ pieces of second selectors of the second conductivity-type. In the voltage generating circuit, the first and second selectors of the first conductivity-type are comprised of MOS transistors, which are parallel in a channel width direction. Among the MOS transistors comprising the second selectors of the first conductivity-type, the MOS transistors connected to the first selector of the first conductivity-type are disposed adjacent to each other in the channel width direction.

SUMMARY OF THE INVENTION

In recent years, display panels have higher definition, while at the same time, cost reduction in the display panels are required. Therefore, sophisticated driver circuits are required at low costs. For example, in the case of a display panel that can offer 256-gradation display, the driver circuit is required to generate gradation voltages corresponding to 256 gradation levels. In the case of, for example, a display panel having 1440 data lines, the driver circuit is required to select and output a gradation voltage, out of 256 gradation voltages, which corresponds to pixel data for each of the data lines.

For example, the source driver has a plurality of lines that transfer each of a plurality of gradation voltages, which are generated in a gradation voltage generating circuit, to a decoder circuit including decoders, the number of which corresponds to the number of data lines. In the following description, these lines are referred to as gradation voltage wirings. The gradation voltage wirings are each connected to each of the decoders of the decoder circuit in parallel. For example, when the decoders in the decoder circuit are aligned, the gradation voltage wirings are formed along the length of a column direction of the decoder circuit.

These gradation voltage wirings are generally the longest wirings in one IC in most cases. Therefore, the gradation voltage wirings tend to be most affected by wiring resistance in all the interconnections. For example, the gradation voltage transferred to a decoder close to the gradation voltage generating circuit is slightly different in voltage value from the gradation voltage transferred to a decoder furthest from the gradation voltage generation circuit. At the time when image data is switched, e.g., at the time when scan lines to be scanned are switched in the gate driver, momentary attenuation (also called a voltage drop or an IR drop) of gradation voltages occurs.

The influence of the IR drop is cleared with passage of time, and the potentials of the gradation voltage wirings converge on (come back to) the potentials transferred from the gradation voltage generating circuit. However, as a distance from the gradation voltage generating circuit is larger, it takes longer time to restore the potential from the IR drop. Accordingly, if the potential does not come back to a desired gradation potential by the next time when image data is switched, different voltages are applied to the data lines, which may cause image quality defects (variations in color and luminance) on the display panel. This problem arises not only in the case of changing output gradation voltages on the basis of the timing of switching image data, but also in the case of continuously outputting the same gradation voltages. Since parasitic capacitive coupling by a plurality of capacitors also occurs, the influence of the voltage drop is not negligible. The influence of the voltage drop is also often difficult to suppress.

The present invention has been made in view of the above stated circumstances and has as its object to provide a driver circuit capable of rapidly restoring voltages to achieve stable output of the gradation voltages when gradation voltage wirings have a voltage drop.

A driver circuit driving a display device according to the present invention includes: a gradation voltage generating circuit for generating m gradation voltages (m is an integer larger than or equal to 2) indicative of m stages of gradation levels; n decoder circuits (n is an integer larger than or equal to 2) each for selecting and outputting, out of the m gradation voltages, n drive voltages corresponding to n data pieces on the basis of n input gradation signals; m gradation voltage wirings each for transferring the m gradation voltages to the n decoder circuits, respectively; and a charge supplementing circuit for supplementing, if a voltage drop occurs in any one or more of the m gradation voltage wirings, each of the any one or more of the m gradation voltage wirings with an amount of electric charge.

The driver circuit according to the present invention can rapidly and reliably restore voltages to achieve stable output of gradation voltages when a voltage drop occurs in the gradation voltage wirings at the time of, for example, switching image data.

DETAILED DESCRIPTION OF THE INVENTION

Hereinbelow, embodiments of the present invention will be described in detail.

First Embodiment

Figure 1:
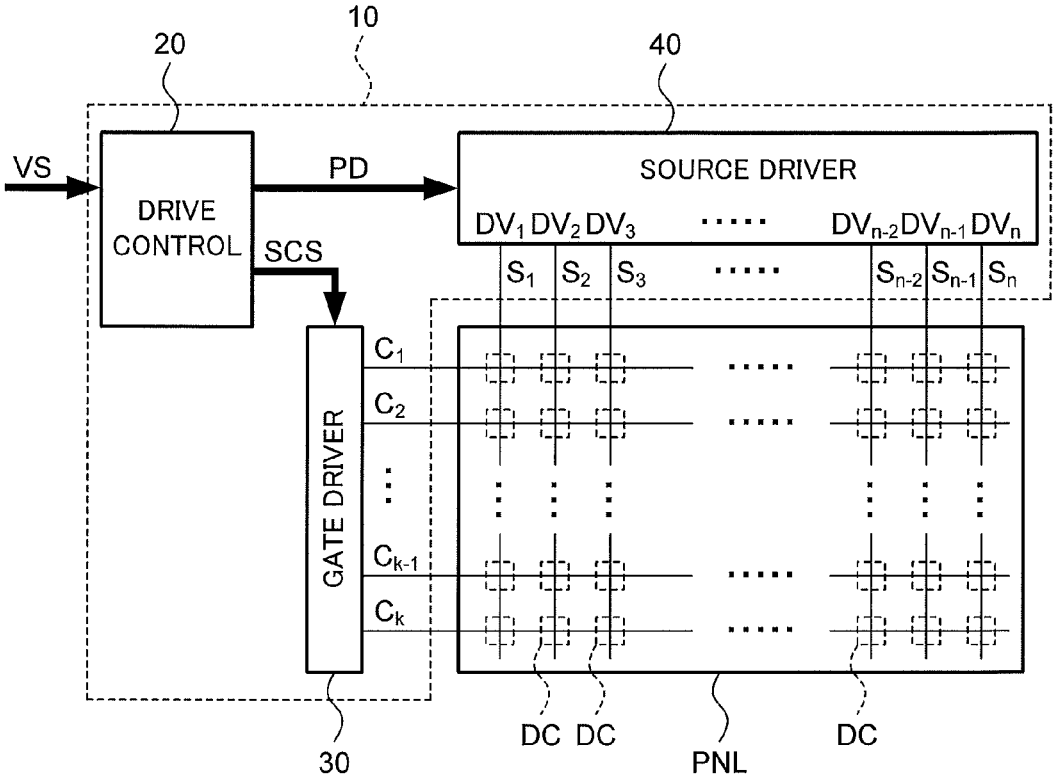
FIG. 1 is a block diagram illustrating a configuration of a driver circuit of a first embodiment.

FIG. 1 is a block diagram illustrating a configuration of a driver circuit 10 according to a first embodiment of the present invention. The driver circuit 10 displays a video image on a display panel PNL, such as liquid crystal panels, plasma panels, and organic electroluminescence (EL) panels, on the basis of a video signal VS input from the outside, for example. The display panel (hereinafter simply referred to as a panel) PNL is configured to display two-dimensional images.

The panel PNL has k (k is an integer larger than or equal to 2) scan lines $C_1$ to $C_k$ each extending in a horizontal direction on a two-dimensional screen. The panel PNL also has n (n is an integer larger than or equal to 2) data lines $S_1$ to $S_n$ each extending in a vertical direction on the two-dimensional screen. At intersections between each of the scan lines $C_1$ to $C_k$ and each of the data lines $S_1$ to $S_n$, display cells DC are provided to carry pixels of the panel PNL. In the description of the present embodiment, the display panel PNL is comprised of, for example, a thin film transistor (TFT) liquid crystal panel.

The driver circuit 10 has a drive control circuit 20, a gate driver 30, and a source driver 40. The drive control circuit 20 generates, on the basis of the video signal VS, a scanning control signal SCS that controls sequential application of scanning pulses to each of the scan lines $C_1$ to $C_k$, and supplies the signal SCS to the gate driver 30. The gate driver 30 generates scanning pulses according to the timing in accordance with the scanning control signal SCS, and applies the scanning pulses to the scan lines $C_1$ to $C_k$ of the panel PNL in a sequential and alternative manner.

The drive control circuit 20 also generates pixel data PD on the basis of the video signal VS. The pixel data PD indicates the luminance level (gradation level) of each pixel. The pixel data PD is supplied, data for one scan line at a time, to the source driver 40 in synchronization with a scanning clock signal in a serial mode. On the basis of the pixel data PD, the source driver 40 generates drive voltages $DV_1$ to $DV_n$ corresponding to the gradation levels of pixels (n pixels) included in one scan line. The source driver 40 also has n output circuits each configured to output a driving pulse having each of the drive voltages $DV_1$ to $DV_n$. The drive voltages $DV_1$ to $DV_n$ are applied to the data lines $S_1$ to $S_n$, respectively.

Figure 2:
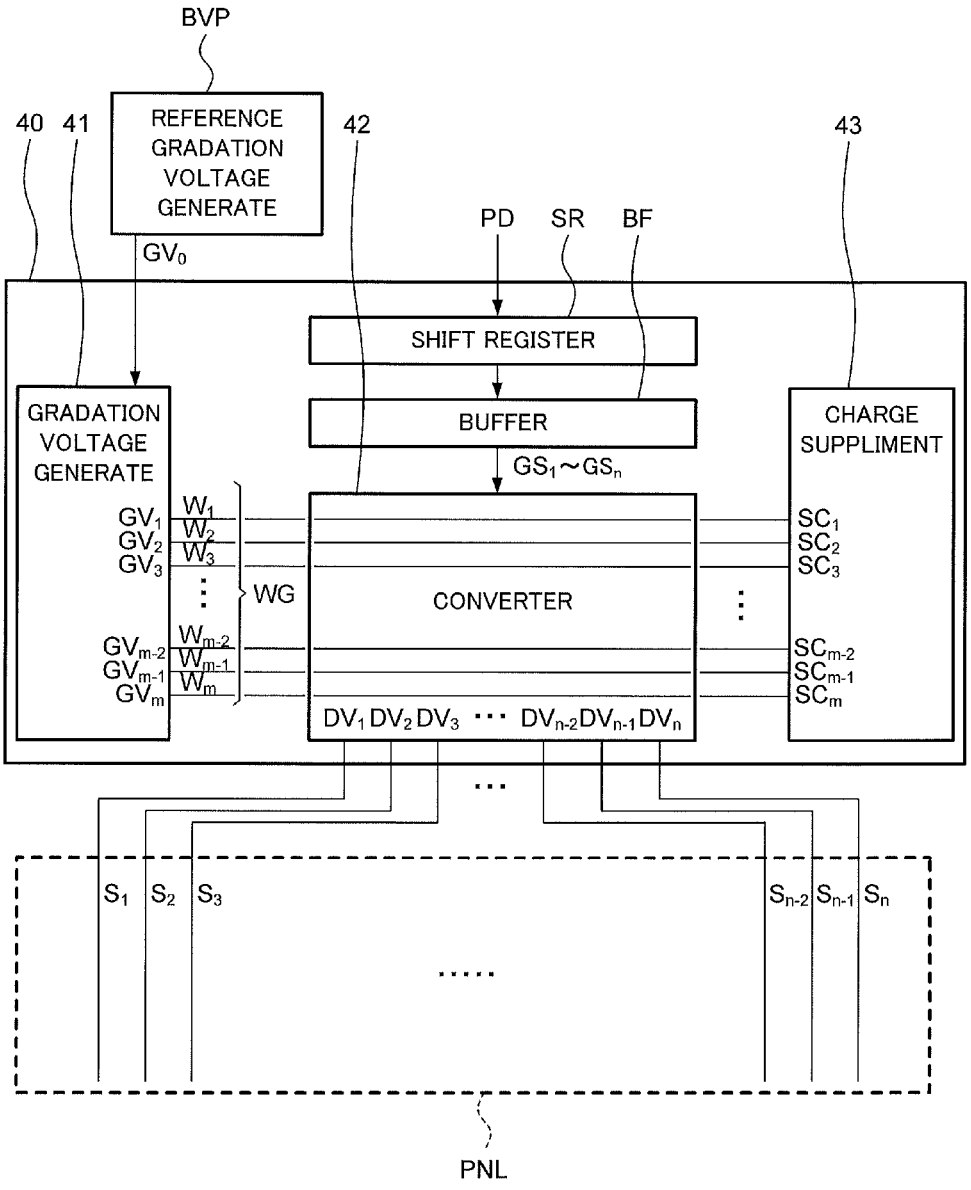
FIG. 2 is a block diagram illustrating a configuration of a source driver in the driver circuit of the first embodiment.

FIG. 2 is a detailed block diagram of the source driver 40. The source driver 40 has a gradation voltage generating circuit 41, a converter circuit 42, and a charge supplementing circuit 43. The gradation voltage generating circuit 41 generates m (m is an integer larger than or equal to 2) gradation voltages $GV_1$ to $GV_m$, which indicate the gradation level of m stages, on the basis of a reference gradation voltage $GV_0$ input from an external reference gradation voltage generating circuit BVP. For example, the gradation voltage generating circuit 41 has a ladder resistor (not illustrated) constituted of a plurality of resistors connected in series, with a power supply potential (a first power supply potential) and a ground potential (a second power supply potential) being applied to end portions, respectively. The gradation voltage generating circuit 41 extracts voltages divided by each resistor included in the ladder resistor to generate m gradation voltages $GV_1$ to $GV_m$. For example, the gradation voltage $GV_1$ has a potential closest to the ground potential, and the gradation voltage $GV_m$ has a potential closest to the power supply potential.

The converter circuit 42 receives n (n is the number of data lines) gradation signals $GS_1$ to $GS_n$ that are digital signals input from the drive control circuit 20. The converter circuit 42 has n decoder circuits 42(1) to 42(*n*) (see FIG. 3). The decoder circuits 42(1) to 42(*n*) select, out of the gradation voltages $GV_1$ to $GV_m$, n drive voltages $DV_1$ to $DV_n$ corresponding to n display data pieces, respectively, on the basis of the input gradation signals $GS_1$ to $GS_n$, and output the respective selected gradation voltages. The output n drive voltages $DV_1$ to $DV_n$ are applied to the data lines $S_1$ to $S_n$, respectively.

More specifically, the drive control circuit 20 has a timing controller (not illustrated) which generates pixel data PD on the basis of the video signal VS. The pixel data PD indicates the luminance levels to be applied to the display cells DC formed at the intersections between each of the scan lines currently scanned and the data lines $S_1$ to $S_n$. A shift register circuit SR generates n gradation signals $GS_1$ to $GS_n$ on the basis of the pixel data PD. For example, the gradation signals $GS_1$ to $GS_n$ are each an eight-bit digital signal. More specifically, the gradation signals $GS_1$ to $GS_n$ each have eight signals corresponding to "0" data or "1" data, for example, and combination of these data sets represents the luminance level of the target display cells DC.

Figure 3:
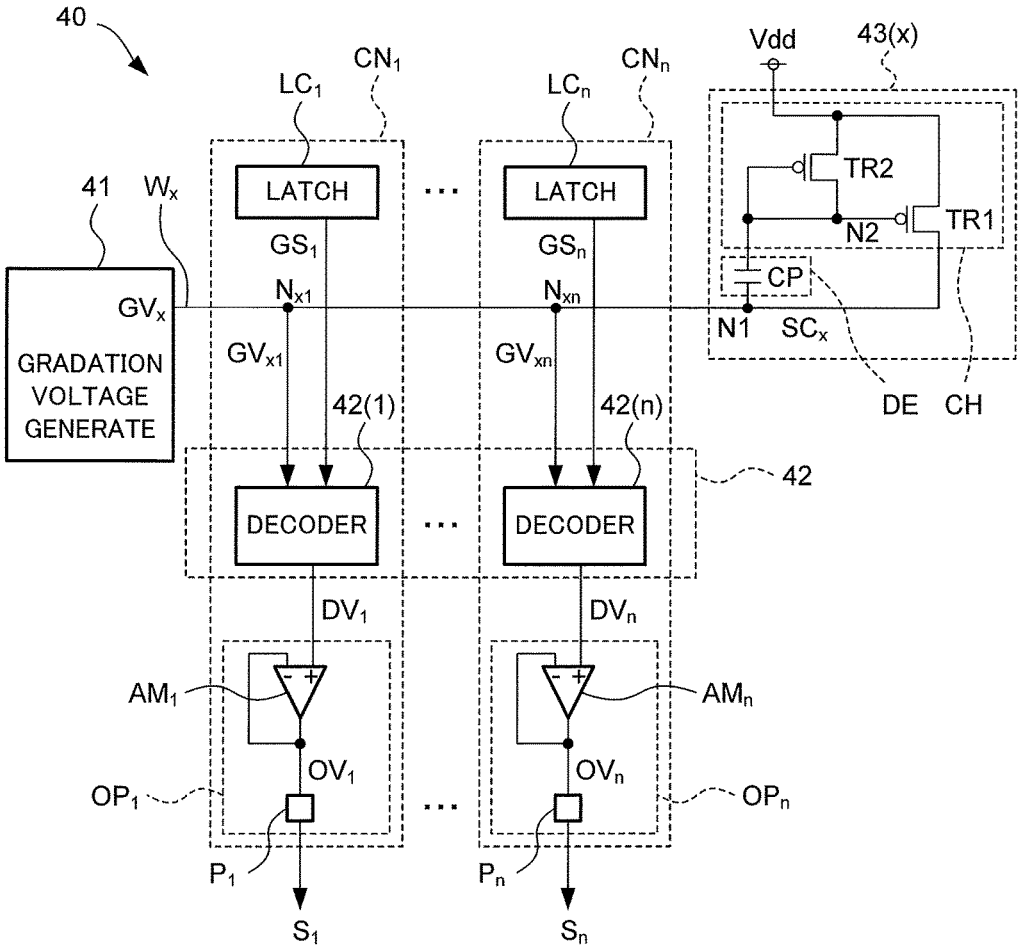
FIG. 3 is a block diagram illustrating configurations of channels and an auxiliary circuit in the source driver of the first embodiment.

The gradation signals $GS_1$ to $GS_n$ are each held by a buffer circuit BF. The buffer circuit BF includes n latch circuits $LC_1$ to $LC_n$ (FIG. 3). On the basis of an input latch signal (not illustrated), the latch circuits $LC_1$ to $LC_n$ each simultaneously supply each of the gradation signals $GS_1$ to $GS_n$ to each of the decoder circuits 42(1) to 42(*n*) of the converter circuit 42. In this manner, the gradation signals $GS_1$ to $GS_n$ are each supplied to the converter circuit 42, and the converter circuit 42 generates drive voltages $DV_1$ to $DV_n$ on the basis of these gradation signals. The source driver 40 applies driving pulses each having each drive voltage $DV_1$ to $DV_n$ to each of the data lines $S_1$ to $S_n$ of the panel PNL. This process is performed in sequence on each of the scan lines $C_1$ to $C_k$, resulting in an image displayed on the panel PNL.

The source driver 40 has a gradation voltage wiring group WG including m gradation voltage wirings $W_1$ to $W_m$. The gradation voltage wirings $W_1$ to $W_m$ transfer m gradation voltages $GV_1$ to $GV_m$ to the decoder circuits 42(1) to 42(*n*) of the converter circuit 42. For example, in the case of displaying a 256-gradation image on the panel PNL (i.e., in the case of m=256), 256 gradation voltage wirings $W_1$ to $W_{266}$ are connected to between the gradation voltage generating circuit 41 and the converter circuit 42. The gradation voltage wiring $W_1$ transfers a gradation voltage $GV_1$ indicative of a 1st gradation level to the converter circuit 42. Similarly, a gradation voltage $GV_{256}$ indicative of a 256th gradation level is transferred through a gradation voltage wiring $W_{256}$.

As illustrated in FIG. 2, the source driver 40 has a charge supplementing circuit 43. When a voltage drop occurs in each of the gradation voltage wirings $W_1$ to $W_m$, the charge supplementing circuit 43 supplements each of the gradation voltage wirings $W_1$ to $W_m$, where the voltage drop occurs, with an amount of electric charges $SC_1$ to $SC_m$. More specifically, the charge supplementing circuit 43 includes m auxiliary circuits 43(1) to 43(*m*) (FIG. 3, for example). The auxiliary circuits 43(1) to 43(*m*) are connected to the gradation voltage wirings $W_1$ to $W_m$, respectively. The auxiliary circuits 43(1) to 43(*m*) supplement the gradation voltage wirings $W_1$ to $W_m$ with the electric charges $SC_1$ to $SC_m$, respectively.

The auxiliary circuits 43(1) to 43(*m*) detect a voltage drop (IR drop) in the gradation voltage wirings $W_1$ to $W_m$, respectively. When a voltage drop is detected in each of the gradation voltage wirings $W_1$ to $W_m$, the auxiliary circuits 43(1) to 43(*m*) supplement the gradation voltages $W_1$ to $W_m$ with the electric charges $SC_1$ to $SC_m$, i.e., the auxiliary circuits 43(1) to 43(*m*) supply the electric charges $SC_1$ to $SC_m$ to the gradation voltages $W_1$ to $W_m$, respectively. For example, the charge supplementing circuit 43 is configured to supplement the gradation voltage wirings $W_1$ to $W_m$ with the electric charges $SC_1$ to $SC_m$, respectively, at the time when the pixel data PD is switched, i.e., at the time when the gradation signals $GS_1$ to $GS_n$ are switched to next gradation signals $GS_1$ to $GS_n$.

Since the source driver 40 has the charge supplementing circuit 43, the amount of electric charges $SC_1$ to $SC_m$ are supplied to the respective gradation voltage wirings $W_1$ to $W_m$ when a voltage drop occurs in the respective gradation voltage wirings $W_1$ to $W_m$ so as to compensate for the dropped voltage. Therefore, even when an IR drop occurs, for example, it becomes possible to rapidly stabilize each of the gradation voltages $GV_1$ to $GV_m$. This makes it possible to reliably prevent the gradation voltages $GV_1$ to $GV_m$ from being attenuated by the IR drop into voltages smaller than each of the original voltages and being applied as drive voltages $DV_1$ to $DV_m$ to the respective data lines $S_1$ to $S_n$. As a result, image quality defects can be suppressed.

FIG. 3 is a circuit diagram illustrating a detailed configuration of the source driver 40. To provide clear understanding, FIG. 3 illustrates only a gradation voltage wiring $W_x$ indicative of an x-th gradation level (x is an integer that satisfies the relation of $1 \leq x \leq m$) included in the gradation voltage wiring group WG. FIG. 3 also illustrates only an auxiliary circuit 43(*x*) connected to the gradation voltage wiring $W_x$, among the charge supplementing circuits 43.

To provide clear understanding, FIG. 3 also illustrates only part of the buffer circuit BF and the converter circuit 42, the part including a latch circuit $LC_1$ and a decoder circuit 42(1) disposed at positions closest to the gradation voltage generating circuit 41, a latch circuit $LC_n$ and a decoder circuits 42(*n*) disposed at positions most distant from the gradation voltage generating circuit 41, and their peripheral circuits.

The decoder circuit 42(1) is connected to a connection node $N_{x1}$ having a smallest wiring distance from the gradation voltage generating circuit 41 in the converter circuit 42. The decoder circuit 42(*n*) is connected to a connection node $N_{xn}$ having a largest wiring distance from the gradation voltage generating circuit 41 in the converter circuit 42. For the sake of easy understanding, as illustrated in FIG. 3, a gradation voltage $GV_x$ supplied to the decoder circuit 42(1) from the gradation voltage wiring $W_x$ through the connection node $N_{x1}$ is referred to as a gradation voltage $GV_{x1}$, and the gradation voltage $GV_x$ supplied to the decoder circuit 42(*n*) through the connection node $N_{xn}$ is referred to as a gradation voltage $GV_{xn}$.

With reference to FIG. 3, more detailed configuration and operation of the source driver 40 will be described. The decoder circuit 42(1) receives a supply of the gradation voltage $GV_x$ ($GV_{x1}$) indicative of the x-th gradation level from the gradation voltage generating circuit 41 through the gradation voltage wiring $W_x$. The decoder circuit 42(1) also receives an input of gradation signal $GS_1$ indicative of a voltage value to be applied to the data line $S_1$ from the latch circuit $LC_1$. Although not illustrated, the gradation voltages $GV_1$ to $GV_m$ from the gradation voltage wirings $W_1$ to $W_m$ are each transferred to the decoder circuit 42(1). On the basis of the gradation signal $GS_1$, the decoder circuit 42(1) selects a drive voltage $DV_1$, out of m gradation voltages $GV_1$ to $GV_m$ including the gradation voltage $GV_x$, and outputs the selected drive voltage $DV_1$.

The drive voltage $DV_1$ is converted into an output drive voltage $OV_1$ in an amplifying circuit $AM_1$, and is output to the data line $S_1$ from a pad $P_1$ serving as an output terminal. In the following description, the amplifying circuit $AM_1$ and the pad $P_1$ may collectively be referred to as an output circuit $OP_1$.

Similarly, the decoder circuit 42(*n*) receives a supply of a gradation voltage $GV_x$ ($GV_{xn}$) indicative of the x-th gradation level from the gradation voltage generating circuit 41 through the gradation voltage wiring $W_x$. The decoder circuit 42(*n*) also receives an input of gradation signal $GS_n$ indicative of a voltage value to be applied to the data line $S_n$ from the latch circuit $LC_n$. Although not illustrated, the gradation voltages $GV_1$ to $GV_m$ from the gradation voltage wirings $W_1$ to $W_m$ are each transferred to the decoder circuit 42(*n*). The decoder circuit 42(*n*) selects a drive voltage $DV_n$, out of m gradation voltages $GV_1$ to $GV_m$ including the gradation voltage $GV_x$, on the basis of the gradation signal $GS_n$, and outputs the selected drive voltage $DV_n$. The drive voltage $DV_n$ is output from an output circuit $OP_n$ (an amplifying circuit $AM_n$ and a pad $P_n$) to the data line $S_n$ as an output drive voltage $OV_n$.

In the following description, the latch circuit $LC_1$, the decoder circuit 42(1), and the output circuit $OP_1$ may collectively be referred to as a channel $CN_1$. Similarly, the latch circuit $LC_n$, the decoder circuit 42(*n*), and the output circuit OPn may collectively be referred to as a channel $CN_n$.

The auxiliary circuit 43(*x*) has a detection circuit DE configured to detect a voltage drop in the gradation voltage wiring $W_x$ which is subjected to supplementation with an electric charge $SC_x$. The auxiliary circuit 43(*x*) also has a charge supply circuit CH for supplying an electric charge $SC_x$ to the gradation voltage wiring $W_x$, when detection circuit DE detects the voltage drop in the gradation voltage wiring $W_x$.

The auxiliary circuit 43($x$) is connected to the connection node $N_{xn}$ having a largest wiring distance from the gradation voltage generating circuit 41, among connection nodes $N_{x1}$ to $N_{x1}$ between the gradation voltage wiring $W_x$ and the decoder circuits 42(1) to 42($n$). In the following description, a connection node (connection node $N_{xn}$ in this embodiment) of the auxiliary circuit 43($x$) connected to the gradation voltage wiring $W_x$ may be distinguished from a connection node N1 for the sake of easy understanding.

The detection circuit DE of the auxiliary circuit 43($x$) includes a capacitor CP having one end connected to the connection node N1 (i.e., to the gradation voltage wiring $W_x$). The charge supply circuit CH includes a MOS transistor (first MOS transistor which is hereinbelow simply referred to as a transistor) TR1. The transistor TR1 has a drain connected to one end of the capacitor CP, a gate connected to the other end of the capacitor CP, and a source to which a power supply potential vdd is applied. The charge supply circuit CH also includes a MOS transistor (second MOS transistor which is hereinbelow simply referred to as a transistor) TR2. The transistor TR2 has a gate and a drain both connected to the other end of the capacitor CP and a source to which the power supply potential Vdd is applied. In the description of this embodiment, the MOS transistors TR1 and TR2 are each a p-channel type MOSFET. A node at the other end of the capacitor CP is herein referred to as a node N2 for convenience of description.

Figure 4A:
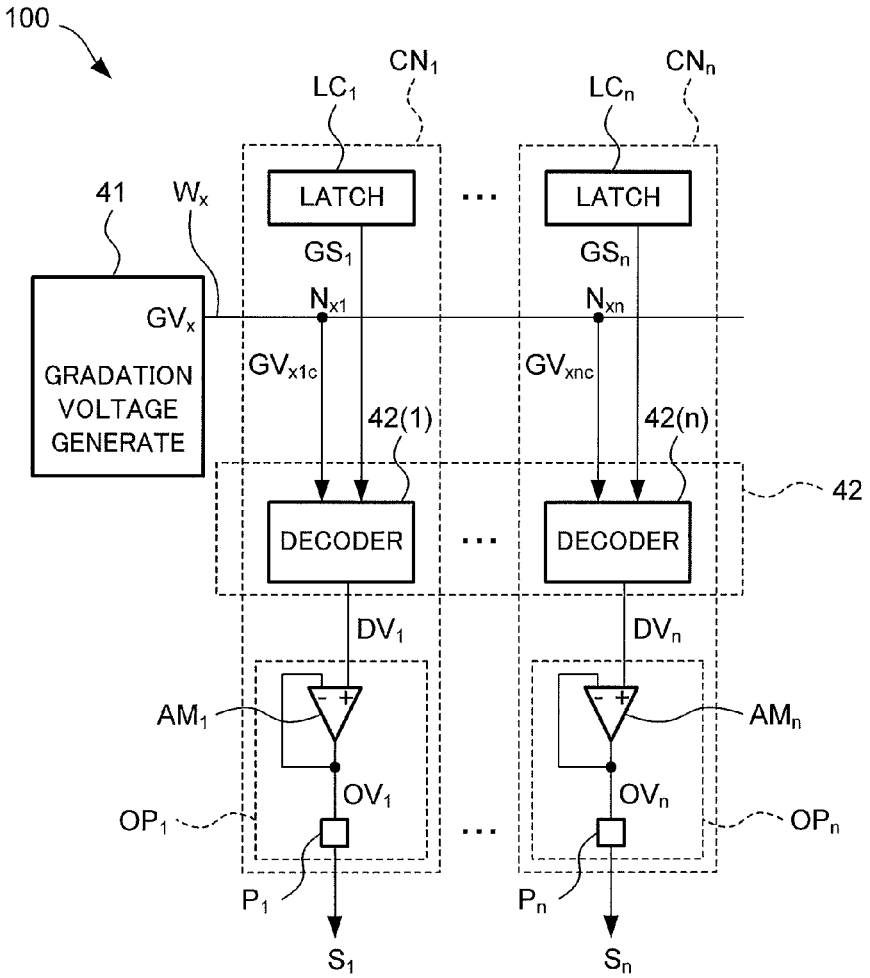
FIG. 4A is a block diagram illustrating a configuration of a source driver in a driver circuit according to a comparative example of the first embodiment.

FIG. 4A is a circuit diagram illustrating the configuration of a source driver 100 of a comparative example, which is used for comparison with the transition (variations) of the gradation voltages in the gradation voltage wirings $W_1$ to $W_m$ of the source driver 40 in this embodiment. FIG. 4A is a circuit diagram of the source driver 100 similar to the circuit diagram illustrated in FIG. 3. The source driver 100 is similar in configuration to the source driver 40 except for the point that the charge supplementing circuit 43 is not provided.

Figure 4B:
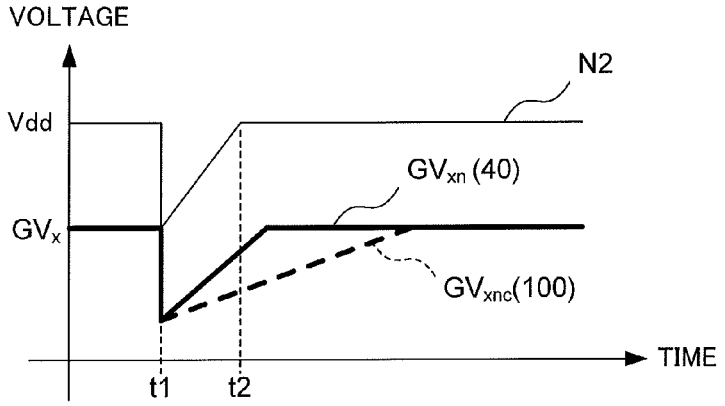
FIG. 4B illustrates potential transition in gradation voltage wirings in the first embodiment and the comparative example.

FIG. 4B illustrates transition in the gradation voltages (gradation voltages $GV_{xn}$ and $GV_{xnc}$) indicative of the x-th gradation level supplied to the decoder circuit 42 ($n$) in the source driver 40 (first embodiment) and the source driver 100 (comparative example), i.e., potential transition in a connection node $N_{Xn}$. In FIG. 4B, the horizontal axis represents time and the vertical axis represents voltage. A thick solid line in the drawing represents the gradation voltage $GV_{xn}$, and a broken line represents the gradation voltage $GV_{xnc}$. FIG. 4B also illustrates potential transition in a node N2 in the charge supplementing circuit 43 (expressed by a solid thin line) for convenience of description.

A description is now given of charge supply operation in the charge supplementing circuit 43, and the gradation voltage $GV_{xn}$ with reference to FIG. 4B. First, at the time before the pixel data PD is switched, both the gradation voltages $GV_{xn}$ and $GV_{xn}$ have a voltage value equal to the gradation voltage $GV_x$. At this point, a current path between the source and the drain is nonconductive in each of the transistors TR1 and TR2 of the auxiliary circuit 43($x$).

Next, at time t1, the pixel data PD input into the source driver 40 is switched to pixel data for a next scan line. In response to this switchover, the gradation signals $GS_1$ to $GS_n$ to be input into the converter 42 are switched. At this point, assume that a gradation signal GS' for selecting a gradation voltage $GV_x$ is input into the decoder circuit 42(1) in the converter circuit 42, for example. In this case, the gradation voltage $GV_x$ transferred to the connection node $N_{x1}$ from the gradation voltage wiring $W_x$ is output as a drive voltage $DV_1$ by the decoder circuit 42(1).

In such a case, at the time t1, the potential $GV_x$ of the gradation voltage wiring $W_x$ drops temporarily (i.e., an IR drop occurs.). In response to this IR drop, the potential $GV_{xn}$ in the connection node $N_{xn}$ also temporarily drops in unison. At the same time, capacitive coupling occurs in the capacitor CP serving as a detection circuit DE of the auxiliary circuit 43($x$), which results in a potential drop in the node N2. In this manner, the capacitor CP detects the voltage drop of the gradation voltage wiring $W_x$.

Once the potential in the node N2 drops, a potential difference is generated between the gate and the source of the transistor TR1. When the potential difference increases to the point that the voltage Vgs between the gate and the source of the transistor TR1 becomes larger than a threshold voltage Vt, a path between the source and the drain of the transistor TR1 becomes conductive. Once the path between the source and the drain of the transistor TR1 becomes conductive, the power supply potential Vdd is applied to the connection node N1. If a voltage drop occurs in the gradation voltage wiring $W_x$ as a result, an electric charge (supplementary charge) $SC_x$ is supplied to the connection node $N_{xn}$ from the auxiliary circuit 43($x$).

The potential drop in the node N2 also causes a potential difference between the gate and the source of the transistor TR2. When the voltage Vgs between the gate and the source of the transistor TR1 becomes larger than the threshold voltage Vt, a path between the source and the drain of the transistor TR2 becomes conductive. As a consequence, the power supply potential Vdd is applied to the node N2. Once the potential in the node N2 reaches the power supply potential Vdd at the time t2, the path between the source and the drain becomes nonconductive in each of the transistors TR1 and TR2. As a consequence, the auxiliary circuit 43($x$) is turned off (put in a standby state).

In the present embodiment, the charge supplementing circuit 43 is provided to supplement each of the gradation voltage wirings $W_1$ to $W_m$ with an amount of electric charges SC' to $SC_m$ when a voltage drop occurs in the gradation voltage wirings $W_1$ to $W_m$. Therefore, in the case where the IR drop occurs in the gradation voltage wirings $W_1$ to $W_m$ at such a time when, for example, the gradation signal $GS_1$ to $GS_n$ are switched, the potentials of the gradation voltage wirings $W_1$ to $W_m$ can rapidly be restored to the gradation voltages $GV_1$ to $GV_m$. As a result, possibilities of image quality defects can be reduced. The charge supplementing circuit 43 also operates so as to respond to the voltage drop in the gradation voltage wirings $W_1$ to $W_m$. Therefore, charge supply operation is executed only at the time when the voltage drop occurs, which enables the charge supplementing circuit 43 to operate at low power consumption.

Next, transition in the potentials in the connection node $N_{xn}$ of the gradation voltage wiring $W_x$ in the source driver 40 of the present embodiment and in the source driver 100 of a comparative example will be described with reference to FIG. 4B. The potential $GV_{xn}$ in the node $N_{xn}$ in the source driver 40 comes back to the gradation potential $GV_x$ in a short time after the operation of the auxiliary circuit 43($x$) is ended (illustrated with a thick solid line in the drawing). On the contrary, the potential $GV_{xn}$ of the node $N_{xn}$ in the source driver 100 comes back to the gradation voltage $GV_x$ in a time longer than the time taken in the source driver 40 (illustrated with a broken line in the drawing). This is because the source driver 40 is supplemented with electric charge by the charge supplementing circuit 43.

The influence of the IR drop is cleared over time. In the connection node $N_{xn}$ which is most affected by the wiring resistance (the connection node having a longest wiring distance from the gradation voltage generating circuit 41), it takes a longest time for the potential $GV_{xn}$ to come back to (converge on) the gradation voltage $GV_x$. Therefore, the present embodiment is configured to increase the speed of restoring the voltage in the connection node which takes a longest time for voltage restoration.

In the case where, for example, the magnitude of the wiring resistance of the gradation voltage wiring is not proportional to the wiring distance from the gradation voltage generating circuit, as in the case of the gradation voltage wirings having varied diameters, it is not necessarily preferable to connect the auxiliary circuit to the gradation voltage wiring having a longest distance from the gradation voltage generating circuit. For example, a connection node in the middle of the gradation voltage wiring may be provided with an auxiliary circuit.

Modified Example 1

Figure 5:
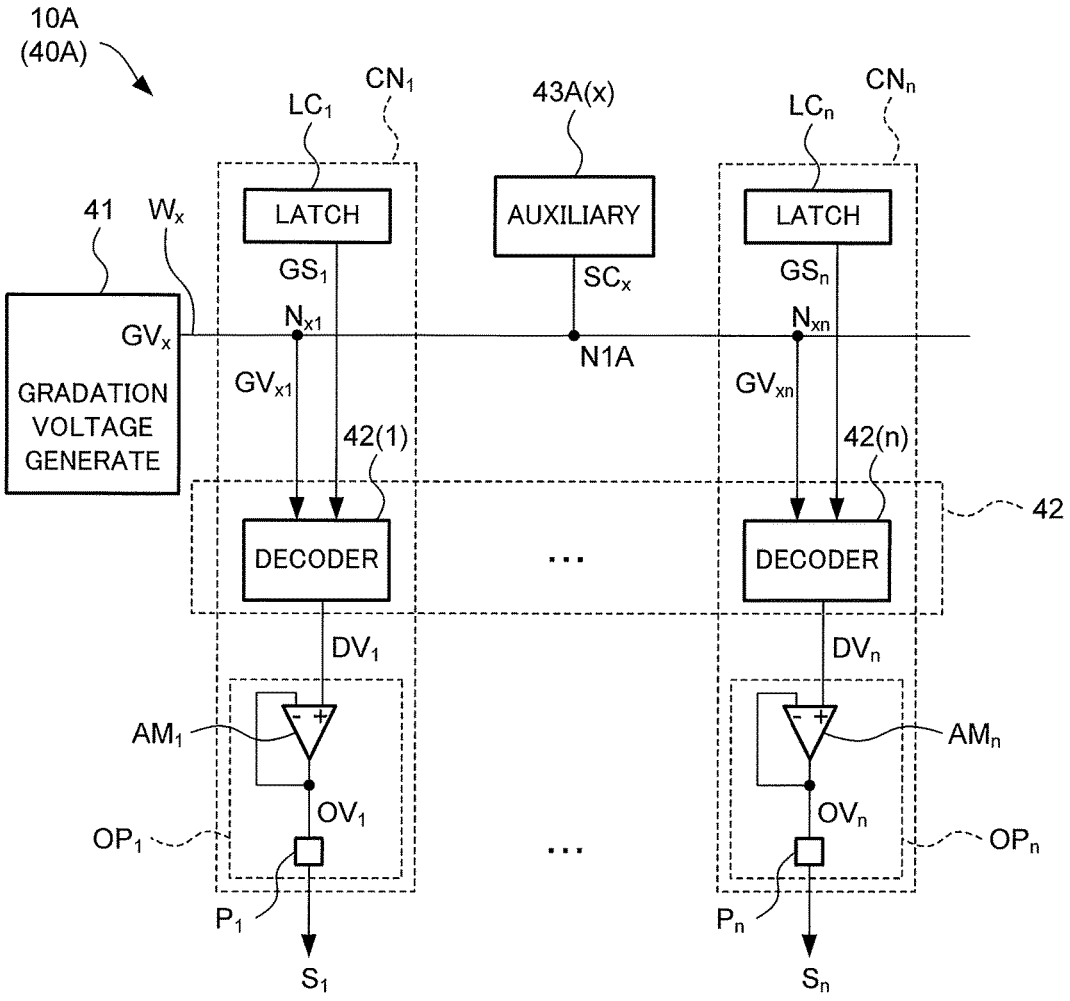
FIG. 5 is a block diagram illustrating a configuration of a source driver in a driver circuit according to a first modified example of the first embodiment.

FIG. 5 is a block diagram illustrating the configuration of a source driver 40A in a driver circuit 10A according to a first modified example of the first embodiment. FIG. 5, which illustrates source driver 40A, is similar to FIG. 3 except that the detailed configuration of an auxiliary circuit 43A is omitted. The source driver 40A is similar in configuration to the source driver 40 except for a connecting position of the auxiliary circuit to the gradation voltage wiring. The charge supplementing circuit 43A (only auxiliary circuit 43A(x) is illustrated in the drawing) is connected to a connection node $N_{1A}$ that is one of the connection nodes, among the connection nodes $N_{x1}$ to $N_{xn}$ between the gradation voltage wiring $W_x$ and the decoder circuits 42(1) to 42(*n*), which is positioned between the connection node $N_{x1}$ with a smallest wiring distance from the gradation voltage generating circuits 41 and a connection node $N_{xn}$ with a largest wiring distance from the gradation voltage generating circuits 41.

The present modified example has a wiring configuration configured such that the wiring resistance is highest in the middle of the gradation voltage wiring $W_x$. This wiring configuration corresponds to, for example, the case where the diameter of the gradation voltage wiring $W_x$ is decreased in the middle of the length of the gradation voltage wiring $W_x$, and the case where the gradation voltage wiring $W_x$ is provided in one wiring layer included in a multilayer wiring layer and is elongated through another layer in the middle of the length of the gradation voltage wiring $W_x$. In these cases, the source driver configured as in the present modified example may clear the influence of the voltage drop most rapidly in all the gradation voltage wirings.

Modified Example 2

Figure 6:
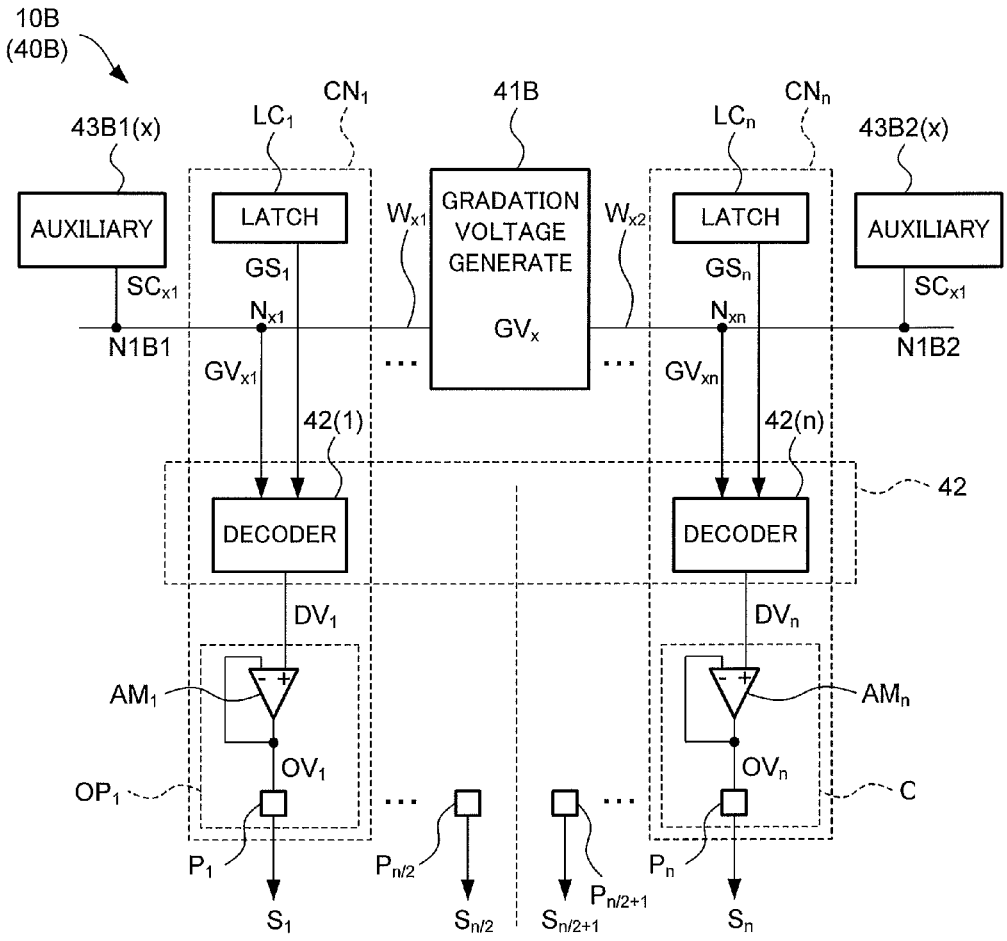
FIG. 6 is a block diagram illustrating a configuration of a source driver in a driver circuit according to a second modified example of the first embodiment.

FIG. 6 is a block diagram illustrating the configuration of a source driver 40B in a driver circuit 10B according to a second modified example of the first embodiment. FIG. 6 is similar to FIG. 3 except that the detailed configuration of first and second charge supplementing circuits 43B1 and 43B2 in the source driver 40B are omitted (only first and second auxiliary circuit 43B1(*x*) and 43B2(*x*) are illustrated in the drawing). The source driver 40B is similar in configuration to the source driver 40 except for the configuration of the gradation voltage wirings $W_{x1}$ and $W_{x2}$, and the configuration of the charge supplementing circuit 43B.

The source driver 40B has a gradation voltage generating circuit 41B provided at the center of the IC chip. From the gradation voltage generating circuit 41B, two gradation voltage wirings (which are referred to as first and second gradation voltage wirings) extend in a longitudinal direction of the chip and in directions opposite from each other.

The first gradation voltage wiring $W_{x1}$ is connected to n/2 decoder circuits 42(1) to 42(*n*/2) through n/2 connection nodes $N_{x1}$ to $N_{xn/2}$. Similarly, the second gradation voltage wiring $W_{x2}$ is connected to n/2 decoder circuits 42(*n*/2+1) to 42(*n*) through n/2 connection nodes $N_{xn/2+1}$ to $N_{xn}$. That is, each of the gradation voltage wirings $W_{x1}$ and $W_{x2}$ has a wiring length half the gradation voltage wiring $W_x$ of the first embodiment. Therefore, the influence of the wiring resistance can be reduced to approximately a half as compared with the first embodiment.

The source driver 40B has a first auxiliary circuit 43B1(*x*) connected to a connection node $N_{x1}$ (N1B1) having a largest wiring distance from the gradation voltage generating circuit 41B, among the connection nodes $N_{x1}$ to $N_{xn/2}$ between the first gradation voltage wiring $W_{x1}$ and the decoder circuits 42(1) to 42(*n*/2). The source driver 40B also has a second auxiliary circuit 43B2(*x*) connected to a connection node $N_{xn}$ (N1B2) having a largest wiring distance from the gradation voltage generating circuit 41B, among the connection nodes $N_{xn/2+1}$ to $N_{xn}$ between the second gradation voltage wiring $W_{x2}$ and the decoder circuits 42(*n*/2+1) to 42(2).

In the present modified example, the driver has two gradation voltage wirings provided to transfer the gradation voltages indicative of the same gradation level. The driver also has the charge supplementing circuit 43B including the first and second charge supplementing circuits 43B1 and 43B2, which are each connected to each of the connection nodes having a largest wiring distance in each of the two gradation voltage wirings. Therefore, it becomes possible to reduce the wiring distance of the gradation voltage wirings to approximately a half, and to suppress the voltage drop in each of the gradation voltage wirings with use of the auxiliary circuits.

Second Embodiment

Figure 7:
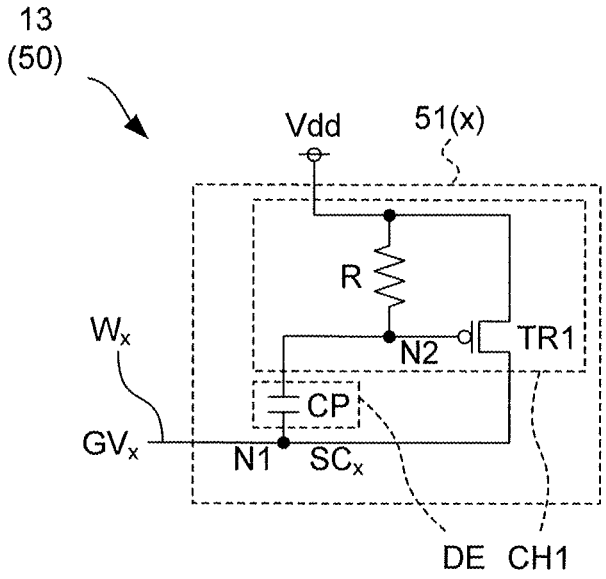
FIG. 7 is a block diagram illustrating a configuration of an auxiliary circuit included in a charge supplementing circuit in a source driver of a driver circuit according to a second embodiment.

FIG. 7 is a block diagram of a source driver 50 in a driver circuit 13 according to a second embodiment. FIG. 7 is a circuit diagram illustrating the configuration of a charge supplementing circuit 51 in the source driver 50. The source driver 50 is similar in configuration to the source driver 40 except for the configuration of the charge supplementing circuit 51. FIG. 7 illustrates only an auxiliary circuit 51(*x*) in the charge supplementing circuit 51, which is connected to the gradation voltage wiring $W_x$ that transfers a gradation voltage $GV_x$. In this embodiment, the auxiliary circuit 51(*x*) has a charge supply circuit CH1. The charge supply circuit CH1 includes a MOS transistor TR1 having a drain connected to one end of a capacitor CP, a gate connected to the other end of the capacitor CP, and a source to which a power supply potential Vdd is applied. The charge supply circuit CH1 also includes a resistor R connected to between the source and the gate of the MOS transistor TR1. In this embodiment, the resistor element R substitutes for the second transistor TR2 in the charge supply circuit CH in the first embodiment.

In the source driver 50, the charge supplementing circuit 51 operates in the same manner as in the first embodiment. More specifically, the resistor element R is constituted by an element having a relatively high resistance, so that the same function as the second MOS transistor TR2 in the first embodiment can be demonstrated. More specifically, the resistor element R has a function of making the MOS transistor (first MOS transistor) TR1 nonconductive after allowing electric charge from the power supply potential Vdd to be supplied as an supplementary current $SC_x$ to a connection node $N_{xn}$ ($N_1$) of the gradation voltage wiring $W_x$.

In this embodiment, as in the first embodiment, the operation of supplementing the gradation voltage wirings $W_1$ to $W_m$ with the electric charges $SC_1$ to $SC_m$ is performed, i.e., the operation of supplying the electric charges SC' to $SC_m$ to the gradation voltage wirings $W_1$ to $W_m$ is performed, in response to a voltage drop occurring in the gradation voltage wirings $W_1$ to $W_m$. Therefore, the voltages dropped due to the IR drop and the like can rapidly be restored to the gradation voltages $GV_1$ to $GV_m$ at low power consumption.

Third Embodiment

Figure 8A:
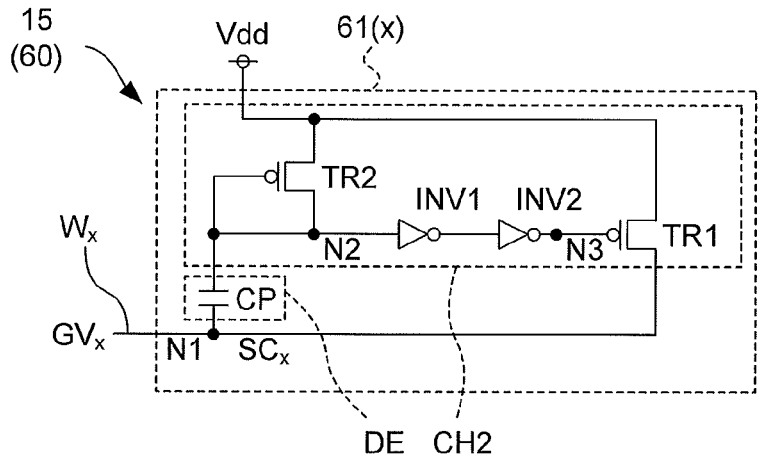
FIG. 8A is a block diagram illustrating a configuration of the auxiliary circuit included in the charge supplementing circuit in the source driver of the driver circuit according to the second embodiment.

FIG. 8A is a block diagram illustrating a configuration of a source driver 60 in a driver circuit 15 according to a third embodiment. FIG. 8A is a circuit diagram illustrating the configuration of a charge supplementing circuit 61 in the source driver 60. FIG. 8A, which illustrates the charge supplementing circuit 61, is similar to FIG. 7. The source driver 60 is similar in configuration to the source driver 40 except for the configuration of the charge supplementing circuit 61. FIG. 8A illustrates only an auxiliary circuit 61(*x*) in the charge supplementing circuit 61. The auxiliary circuit 61(*x*) is connected to a gradation voltage wiring $W_x$ that transfers a gradation voltage $GV_x$.

In this embodiment, the auxiliary circuit 61(*x*) has a charge supply circuit CH2. The charge supply circuit CH2 includes first and second MOS transistors TR1 and TR2 similar to the first embodiment. The charge supply circuit CH2 also includes two inverter elements (which are referred to as first and second inverter elements, respectively) INV1 and INV2, which are connected in series to each other in between the gate of the first MOS transistor TR1 and the drain of the second MOS transistor TR2.

The first inverter element INV1 has an input terminal connected to the other end of the capacitor CP and to the drain of the second MOS transistor TR2. The first inverter element INV1 has an output terminal connected to an input terminal of the second inverter element INV2. The second inverter element INV2 has an output terminal connected to the gate of the first MOS transistor TR1. For example, the first inverter element INV1 has a p-channel type MOSFET, and the second inverter element INV2 has an n-channel type MOSFET. For the sake of easy understanding, a connection node between the output terminal of the second inverter element INV2 and the gate of the first MOS transistor is referred to as a node N3.

Figure 8B:
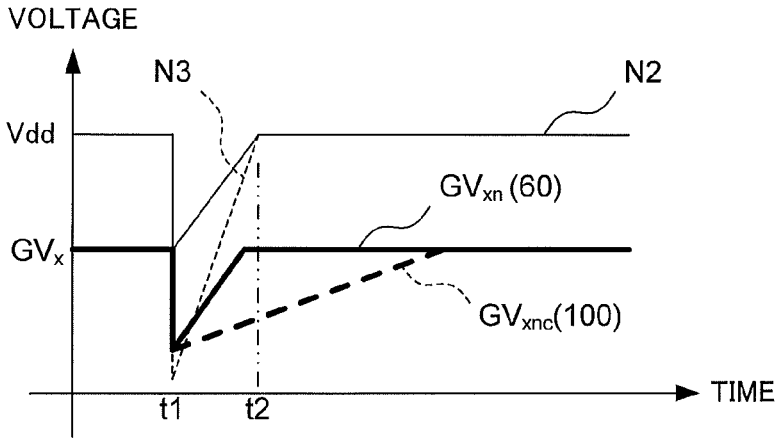
FIG. 8B illustrates potential transition in gradation voltage wirings according to a third embodiment and the comparative example of the first embodiment.

FIG. 8B illustrates transition in the gradation voltages (gradation voltages $GV_{xn}$ and $GV_{xnc}$) indicative of the x-th gradation level supplied to the decoder circuit 42(*n*) in the source driver 60 (third embodiment) and the source driver 100 (comparative example), i.e., transition in potentials in the connection node $N_{xn}$. In FIG. 8B, the horizontal axis represents time and the vertical axis represents voltage. A thick solid line in the drawing represents the gradation voltage $GV_{xn}$, and a thick broken line represents the gradation voltage $GV_{xnc}$. FIG. 8B also illustrates potential transition in the nodes N2 and N3 in the auxiliary circuit 61(*x*) for description (the potentials are expressed with a thin solid line and a thin broken line, respectively).

Now, the charge supply operation of the charge supplementing circuit 61, and the gradation voltage $GV_{xn}$ are described with reference to FIG. 8B. First, at the time before pixel data PD is switched, a path between the source and the drain is nonconductive in each of the transistors TR1 and TR2 as in the case of the auxiliary circuit 43(*x*).

Next, at time t1, the pixel data PD input into the source driver 60 are switched to pixel data PD for a next scan line. In response to this switchover, the gradation signals $GS_1$ to $GS_n$ to be input into the converter 42 are switched. At this point, assume that a gradation signal $GS_1$ for selecting a gradation voltage $GV_x$ is input into the decoder circuit 42(1) in the converter circuit 42, for example. In this case, the gradation voltage $GV_x$ transferred from the gradation voltage wiring $W_x$ to the connection node $N_{x1}$ is output as a drive voltage $DV_1$ by the decoder circuit 42(1).

In such a case, at the time t1, the potential in the gradation voltage wiring $W_x$ drops temporarily (i.e., an IR drop occurs). In response to this IR drop, the potential $GV_{xn}$ in the connection node $N_{xn}$ also temporarily drops in unison. At the same time, capacitive coupling occurs in the capacitor CP serving as a detection circuit DE of the auxiliary circuit 43, which results in a potential drop in the node N2. In this manner, the capacitor CP detects the voltage drop of the gradation voltage wiring $W_x$.

Once the potential in the node N2 drops, a p-channel MOSFET of the inverter element INV1 becomes conductive, and a power supply potential Vdd is output to the inverter element INV2. Consequently, an n-channel type MOSFET of the inverter element INV2 becomes conductive, and a relatively low-level potential is input into the gate of the MOS transistor TR1 (expressed by the thin broken line in the drawing). Therefore, a potential difference larger than that in the first embodiment is generated in between the gate and the source of the MOS transistor TR1.

When the voltage Vgs between the gate and the source of the transistor TR1 becomes larger than the threshold voltage Vt, a path between the source and the drain of the transistor TR1 becomes conductive. Once the path between the source and the drain of the transistor TR1 becomes conductive, the power supply potential Vdd is applied to the connection node N1. Thus, the electric charge $SC_x$ is supplied to the node N1 of the gradation voltage wiring $W_x$.

The potential drop in the node N2 also causes a potential difference between the gate and the source of the transistor TR2. When the voltage Vgs between the gate and the source of the transistor TR2 becomes larger than the threshold voltage Vt, a path between the source and the drain of the transistor TR2 becomes conductive. As a consequence, the power supply potential Vdd is applied to the node N2. When the potential in the node N2 reaches the power supply potential Vdd at time t2, the path between the source and the drain becomes nonconductive in each of the transistors TR1 and TR2. As a consequence, the auxiliary circuit 61(*x*) is turned off (put in a standby state).

In this embodiment, a potential difference larger than that in the first embodiment can be generated in between the gate and the source of the MOS transistor TR1. Therefore, electric charge is supplied to the gradation voltage wiring $W_x$ earlier than in the first embodiment. The potential $GV_{xn}$ in the node $N_1$ comes back to the gradation voltage $GV_x$ before the gate voltage of the MOS transistor TR1 comes back to Vdd, i.e., before the MOS transistors TR1 and TR2 become nonconductive (before the time t2). Therefore, the potential can be restored from the IR drop more rapidly. Therefore, restoration of the potential $GV_{xnc}$ in the gradation voltage wiring $W_x$ can be performed considerably more rapidly than restoration in the comparative example.

In the above description, the charge supply circuits CH, CH1, and CH2 are comprised by using one or two p-channel type MOSFETs. However, the charge supply circuits CH, CH1, and CH2 may be comprised by using an n-channel type MOSFET. For example, an auxiliary circuit formed by an n-channel type MOSFET may be connected to the gradation voltage wirings (such as gradation voltage wirings $W_1$ and $W_2$) that transfer gradation potentials (such as gradation potentials $GV_1$ and $GV_2$) close to the ground potential (second power supply potential).

In the case of the gradation potential $GV_1$ that is close to the ground potential, the ground potential may be applied to the auxiliary circuit formed by using an n-channel type MOSFET to supplement the gradation voltage wiring $W_1$ with electric charge, so that the potential can be restored more rapidly from the IR drop. In the case of the gradation voltage wirings that transfer gradation potentials close to the power supply potential (first power supply potential), it is preferable that electric charge be supplemented from the auxiliary circuit formed by using a p-channel type MOSFET as described before. It is also possible to use both the configurations. For example, it is possible to connect the auxiliary circuit formed by using the p-channel type MOSFET to the gradation voltage wirings that transfer gradation voltages having potentials close to the power supply potential, and to connect the auxiliary circuit formed by using the n-channel type MOSFET to the gradation voltage wirings that transfer gradation voltages having potentials close to the ground potential. That is, the MOS transistor constituting the charge supplementing circuit may be constituted by a p-channel type MOSFET or an n-channel type MOSFET.

Various adjustments may be applied to the threshold voltage Vt of the gate voltage Vgs that is used to trigger conduction between the source and the drain of the MOS transistor TR1 so as to start to supply electric charge, depending on desired charge supply timing and other factors. For example, if it is possible to predict the timing of voltage drop other than the timing relating to switching of the pixel data PD, the threshold voltage Vt may be adjusted (designed) so that the conductive state is achieved at that predicted time.

This application is based on a Japanese Patent application No. 2014-183077 which is hereby incorporated by reference.

What is claimed is:

1. A driver circuit driving a display device comprising:

a gradation voltage generating circuit for generating m gradation voltages (m is an integer larger than or equal to 2) indicative of m stages of gradation levels;

n decoder circuits (n is an integer larger than or equal to 2) each for selecting and outputting, out of the m gradation voltages, n drive voltages corresponding to n data pieces on the basis of n input gradation signals;

m gradation voltage wirings each for transferring the m gradation voltages to said n decoder circuits, respectively; and a charge supplementing circuit for supplementing, if a voltage drop occurs in any one or more of the m gradation voltage wirings, said any one or more of the m gradation voltage wirings with an amount of electric charge.

2. The driver circuit according to claim 1, wherein said charge supplementing circuit includes m auxiliary circuits each for supplementing each of the m gradation voltage wirings with an amount of electric charge, and said m auxiliary circuits are each connected to a connection node having a largest wiring distance from the gradation voltage generating circuit among connection nodes between each of the m gradation voltage wirings and the n decoder circuits.

3. The driver circuit according to claim 2, wherein said m auxiliary circuits supplement the m gradation voltage wirings with an amount of electric charge, respectively, at time when the n gradation signals are switched to next gradation signals.

4. The driver circuit according to claim 2, wherein said m auxiliary circuits each have:

a detection circuit for detecting a voltage drop in the gradation voltage wiring subjected to supplementation with the amount of electric charge; and a charge supply circuit for supplying the amount of electric charge to the gradation voltage wiring upon detection of the voltage drop by the detection circuit.

5. The driver circuit according to claim 4, wherein said detection circuit includes a capacitor having one end connected to the gradation voltage wiring, and said charge supply circuit includes:

a first MOS transistor having a drain connected to the one end of the capacitor, a gate connected to the other end of the capacitor, and a source to which power supply potential is applied, and a second MOS transistor having a gate and a drain connected to the other end of the capacitor, and a source to which the power supply potential is applied.

6. The driver circuit according to claim 4, wherein said detection circuit includes a capacitor having one end connected to the gradation voltage wiring, and said charge supply circuit includes:

a MOS transistor having a drain connected to the one end of the capacitor, a gate connected to the other end of the capacitor, and a source to which a power supply potential is applied; and a resistor element connected to between the source and the gate of the MOS transistor.

7. The driver circuit according to claim 4, wherein said detection circuit includes a capacitor having one end connected to the gradation voltage wiring, and said charge supply circuit includes:

a first MOS transistor having a drain connected to the one end of the capacitor and a source to which the power supply potential is applied;

a second MOS transistor having a gate and a drain connected to the other end of the capacitor, and a source connected to the source of the first MOS transistor; and first and second inverter elements connected in series to each other in between the gate of the first MOS transistor and the drain of the second MOS transistor, the first inverter element having an input terminal connected to the other end of the capacitor CP and to the drain of the second MOS transistor, the first inverter element having an output terminal connected to an input terminal of the second inverter element, the second inverter element having an output terminal connected to the gate of the first MOS transistor.

8. The driver circuit according to claim 3, wherein said m auxiliary circuits each have:

a detection circuit for detecting a voltage drop in the gradation voltage wiring subjected to supplementation with the amount of electric charge; and a charge supply circuit for supplying the amount of electric charge to the gradation voltage wiring upon detection of the voltage drop by the detection circuit.

9. The driver circuit according to claim 8, wherein said detection circuit includes a capacitor having one end connected to the gradation voltage wiring, and said charge supply circuit includes:

a first MOS transistor having a drain connected to the one end of the capacitor, a gate connected to the other end of the capacitor, and a source to which power supply potential is applied, and a second MOS transistor having a gate and a drain connected to the other end of the capacitor, and a source to which the power supply potential is applied.

10. The driver circuit according to claim 8, wherein said detection circuit includes a capacitor having one end connected to the gradation voltage wiring, and said charge supply circuit includes:

a MOS transistor having a drain connected to the one end of the capacitor, a gate connected to the other end of the capacitor, and a source to which a power supply potential is applied; and a resistor element connected to between the source and the gate of the MOS transistor.

11. The driver circuit according to claim 8, wherein said detection circuit includes a capacitor having one end connected to the gradation voltage wiring, and said charge supply circuit includes:

a first MOS transistor having a drain connected to the one end of the capacitor and a source to which the power supply potential is applied;

a second MOS transistor having a gate and a drain connected to the other end of the capacitor, and a source connected to the source of the first MOS transistor; and first and second inverter elements connected in series to each other in between the gate of the first MOS transistor and the drain of the second MOS transistor, the first inverter element having an input terminal connected to the other end of the capacitor CP and to the drain of the second MOS transistor, the first inverter element having an output terminal connected to an input terminal of the second inverter element, the second inverter element having an output terminal connected to the gate of the first MOS transistor.

* * * * *